United States Patent [19]

Berg

[11] 4,188,519

[45] Feb. 12, 1980

[54] PROCESS AND APPARATUS FOR CONTROLLABLY EXCHANGING HEAT BETWEEN TWO BODIES

[75] Inventor: Charles A. Berg, Buckfield, Me.

[73] Assignee: Pyreflex Corporation, Buckfield, Me.

[21] Appl. No.: 888,212

[22] Filed: Mar. 20, 1978

[51] Int. Cl.[2] ..... H05B 9/02; H05B 11/00

[52] U.S. Cl. ..... 219/10.47; 210/10.43; 219/10.49 R; 210/349; 432/82; 266/259

[58] Field of Search ..... 219/10.47, 10.49, 6.5, 219/10.41, 10.67, 7.15, 10.67, 10.43, 10.71, 347, 349, 388 C, 405, 411, 423, 10.55 A; 266/280, 283, 249, 250, 254, 259, 262; 432/82, 226, 120; 350/1.7, 67, 103

[56] References Cited

U.S. PATENT DOCUMENTS

| | | | |
|---|---|---|---|
| 1,286,908 | 12/1918 | Baily | 432/82 |
| 2,428,615 | 10/1947 | Brown | 219/10.49 |
| 2,543,053 | 2/1951 | Parker | 219/10.47 |
| 2,608,740 | 9/1952 | Dany | 432/82 |
| 2,943,174 | 6/1968 | Parker | 219/10.47 |
| 3,627,590 | 12/1971 | Mammel | 219/349 |
| 3,817,710 | 6/1974 | Mizutani et al. | 219/349 |
| 4,058,699 | 11/1977 | Van Vloten | 219/349 |

FOREIGN PATENT DOCUMENTS

| | | | |
|---|---|---|---|
| 938499 | 2/1956 | Fed. Rep. of Germany | 219/349 |
| 1125958 | 3/1962 | Fed. Rep. of Germany | 62/DIG. 1 |
| 927752 | 6/1963 | United Kingdom | 219/10.43 |

*Primary Examiner*—Bruce A. Reynolds
*Assistant Examiner*—Philip H. Leung
*Attorney, Agent, or Firm*—Kenway & Jenney

[57] ABSTRACT

Disclosed is a process and apparatus for recovering high temperature heat normally lost from materials that have been processed at high temperature, and for transferring this heat directly to materials about to be processed. The apparatus comprises a tunnel having an infrared radiation reflective interior surface through which cool incoming and hot exiting workpieces pass. The cross-sectional shape of the tunnel is elliptical, and the workpieces are moved along focal lines so that radiation emitted from hot workpieces is reflected at the interior surface, directed to cool workpieces, and absorbed. A furnace suitable for subjecting a workpiece to a controlled thermal cycle is also disclosed.

23 Claims, 6 Drawing Figures

PROCESS AND APPARATUS FOR CONTROLLABLY EXCHANGING HEAT BETWEEN TWO BODIES

BACKGROUND OF THE INVENTION

Broadly, this invention relates to a process and apparatus for exchanging heat between different-temperature objects capable of emitting and absorbing radiation. More specifically, it relates to a process and apparatus which is useful in conserving heat in systems wherein a line of workpieces are serially heated, worked, and subsequently cooled, and to a method and apparatus for subjecting a workpiece to a controlled thermal cycle wherein the workpiece is heated or cooled at a controlled rate or maintained at a given temperature.

Most industrial thermoprocessing of materials such as metals, ceramics, and glasses takes place at temperatures at or above about 1000° F. At such temperatures, at least half and frequently considerably more of the heat transferred from such materials will be lost via the emission of electromagnetic radiation, predominantly in the infrared but also in visible regions of the spectrum. In general, the higher the temperature of the material in question, the greater is the contribution of such thermal radiation to the total heat loss. For example, a steel part at 1000° F. in an 80° F. ambient environment will have an emissivity of about 0.85 and will radiate about $6.6\times10^3$ BTU/hr per square foot of surface area. Subtracting the background radiation impinging on the part, the net radiative loss amounts to about $6.45\times10^3$ BTU/hr per square foot of surface area. Assuming that the natural convection of air occurs with a convective film coefficient of unity, the net convective loss from the steel part under these conditions will be approximately 920 BTU/hr per square foot. The total heat loss from the part will therefor be 920+6,455=7,375 BTU, 6,455 or 88% of which occurs via emission of radiation. Of course, as the temperature of the material is increased above 1000° F., the radiant heat loss becomes an even greater fraction of the total heat loss.

Some of the consequences of the foregoing phenomenon may be appreciated in the context, for example, of a walking beam preheating furnace in a production steel mill, into which steel billets are introduced in a continuous stream at room temperature. The billets are first heated as they pass over the bed of the beam furnace to approximately 2400° to 2500° F. and are thereafter immediately conveyed to a forming station where mechanical working of the billet takes place. While the workpieces lose some heat at the forming station, they leave the forming station at high temperature, typically in the range of 1500°-2000° F. Similar practices are currently in use in certain types of ferrous forging, copper forming, stainless steel working, and other areas of materials processing, including the production of certain high performance fibers and graphite as well as metals.

With the increasing cost of energy, the concept of somehow transferring heat from the high temperature workpieces exiting the forming station to the incoming pieces at room temperature to conserve heat and decrease total energy requirements becomes increasingly attractive. This general approach to conserving heat has long been appreciated, as evidenced by the disclosures of U.S. Pat. Nos. 1,038,901, 1,286,907, 1,332,501, 1,792,423, and 2,608,740, all of which disclose the concept of conserving heat in situations similar to the foregoing by passing incoming and exiting workpieces through a tunnel-like enclosure so that heat is transferred from higher to the lower temperature workpiece. However, when the relative contribution of radiative and convective heat gain and loss is appreciated, it becomes clear that only a small fraction of the available heat energy will be exchanged when hot and cold workpieces are simply placed in proximity in an enclosure. Thus, of the total radiation emitted, only that fraction which happens to leave the surface of the high temperature object in a direction that will lead it to the cooler object will be transferred.

In addition to the foregoing, there is another area of industrial heat treating where this phenomemon is significant. Specifically, it is often required to pass certain materials such as metals (especially steels) and glass through controlled thermal programs or cycles in which the temperature of the material is held at a fixed value for a given period of time, reduced to a lower value, possibly at a controlled rate, held at the lower temperature for an additional period of time, and otherwise controllably heated, cooled, or maintained at a given temperature. Conventional methods of heat treating materials in this manner involve sequential immersions in a quenching fluid and exposures to hot furnace beds. Typically, problems of control and problems with chemical reactions occurring on the surface of the material are encountered.

Various material processing techniques employing thermal cycling of this type are now in practice, but such techniques could be applied to many other materials if a better and less expensive process and apparatus for subjecting metal or glass to such cycling were available.

SUMMARY OF THE INVENTION

The instant invention takes advantage of the above-noted observation to provide a process and apparatus for exchanging heat between two different temperature objects capable of emitting and absorbing infrared radiation. In its broadest aspects, the process of the invention comprises the steps of providing a chamber having an infrared radiation reflective interior surface which, in at least one cross-sectional plane, substantially describes a true ellipse having a pair of separated foci. Objects are placed at the foci within the chamber so that the object at the higher temperature emits omnidirectional infrared (and at some temperatures, visible) radiation from its surface. By virtue of the nature of the elliptical cavity, radiation from all directions which impinges on the elliptical surface is reflected, directed to (focused on) the other focus, and absorbed by the other object.

If the chamber comprises a tunnel having a longitudinal axis and an infrared radiation reflective interior surface which is elliptical in a plane perpendicular to the axis, heat may be conserved in systems such as those described above wherein a series of low temperature workpieces are conveyed along one focal line of the elliptical tunnel, heated in a furnace, worked at a forming station, and thereafter passed along the other focal line of the tunnel. With this arrangement, high temperature workpieces exiting the forming station emit omnidirectional infrared radiation. This is reflected at the elliptical interior surface and directed to the incoming low temperature workpieces which are thereby preheated. If, on the other hand, no object to be heated is present at the point in the focal line to which an emitted infrared ray is directed, the ray is automatically returned by reflection back to the focus from which it originally came. Heat emitted by the hot object is therefore conserved until a cooler object is in position at the other focus to receive it.

In another application of the process, a temperature controlled body having a surface with a high emissivity is placed at one focus of a sealed ellipsoidal enclosure, and a workpiece which is to be passed through a thermal program is placed at the other focus. The workpiece may then be cooled (or heated) simply by controlling the absorption (or emission) of infrared radiation at the other focus of the ellipsoidal enclosure. This is accomplished by controlling the temperature of the body at the other focus. The workpiece can be heated at the outset such as by an induction coil. Any given temperature can be maintained by balancing the heat loss of the apparatus (by reflective loss or conduction) with heat added to the workpiece by radiation from the temperature controlled body. If the temperature controlled body is cooled, it acts as a heat sink, the net flow of the infrared radiation being from the workpiece to the cooled body.

In another aspect, the invention provides an apparatus for conserving heat in a system wherein a plurality of workpieces are serially heated, worked while in a heated condition, and subsequently cooled. The apparatus comprises a conveyor means for transporting workpieces, a heating station at a point on the conveyor means, a working station at a point downstream from the heating station, and a tunnel having a longitudinal axis parallel to which workpieces on the conveyor pass, both prior to entering the heating station and after exiting the working station in a heated condition. The tunnel has an interior surface which is highly reflective of infrared radiation and which, in planes perpendicular to the axis, describes an ellipse having a pair of separated foci. The portions of the conveyor passing through the tunnel are located adjacent each of the foci so that workpieces on the conveyor moving toward the heating station and exiting from the working station pass along respective focal lines in the tunnel. In preferred embodiments, the tunnel is fitted with reflective end pieces and/or reflective baffles spaced along and perpendicular to the axis which divide the tunnel into compartments and conserve radiation that might normally escape from the tunnel ends.

In still another aspect, the invention provides apparatus for heat treating a workpiece such as by controllably heating and cooling, and/or maintaining a given temperature so that the workpiece can be subjected to a controlled thermal cycle. This apparatus comprises an enclosed chamber having an interior infrared radiation reflective surface which, at least in one cross-section, describes an ellipse having separated foci, a workpiece support located adjacent one focus, and a controllable infrared radiation emitter/absorber located at the other focus. In preferred embodiments, the sealed enclosure has an interior surface in the form of an ellipsoid or a tube having an elliptical cross-section. In the latter case, the emitter/absorber comprises an elongated structure spaced along a focal line. Also, the apparatus may include an induction coil for rapidly heating a workpiece while on the support and an attached pump or the like for evacuating the enclosure or supplying an atmosphere of a given pressure and composition.

The controllable emitter/absorber preferably comprises a hollow tube having a high emissivity surface exposed to the interior of the chamber. A port is provided to the hollow which communicates with the exterior of the chamber so that cooling fluids may be pumped through the emitter/absorber (then acting as an absorber) to cool the workpiece. A high temperature heat source included in the hollow can be used to induce the emission of infrared radiation. Specular reflective surfaces are preferred in all embodiments of the invention.

Accordingly, it is an object of the invention to provide a process and apparatus for conserving energy in a system which transports, heats, and does work on workpieces capable of undergoing changes in temperature by emission and absorption of radiation, e.g., metal, glass, or a ceramic material workpieces.

Another object of the invention is to provide a unique method of exchanging heat between two objects via the emission and absorption of infrared radiation.

Still another object of the invention is to provide a process for passing materials through a thermal cycle which may include periods of controlled heating and cooling and the maintenance of the material at a given temperature.

Still another object of the invention is to provide a heat treating furnace which may be adapted to effect material working processes which must be done at high temperature and under a controlled atmosphere.

These and other objects of the invention will be apparent from the following description of some important embodiments and from the drawing.

DESCRIPTION OF PREFERRED EMBODIMENTS

Broadly, the invention is based on the realization that (a) at temperatures above about 1000° F., the dominant mechanism for gaining or losing heat in many materials is through infrared emission and absorption, and that (b) omnidirectional radiation emitted from a focus in a chamber having the interior form of an ellipsoid or from a focal line in an elongated elliptical cross-sectional tunnel having ellipsoidal ends will be specifically directed to the other focus or focal line of the chamber if its interior surface is reflective to the emitted radiation. Thus, an object placed at one focus may be heated, cooled, or maintained at a given elevated or depressed temperature if a controllable infrared (and/or visible) radiation emission/absorption device is located at the other focus. In practice, 100% radiative transfer can never be obtained since surfaces of 100% reflectivity cannot be constructed and since the radiation emitter-/absorber and the object to be heat treated cannot take the form of point sources or lines, and thus cannot be truly at the focal points. However, as long as the objects from and to which radiation is to be transferred have a cross-sectional dimension (in the same plane as the elliptical cross-section) which is small in comparison with either semi-axis of the ellipse, such losses will be minimized. In general, it is believed that best results will be obtained when the objects have a cross-section no greater than 10% of the minor semi axis.

Figure 1:
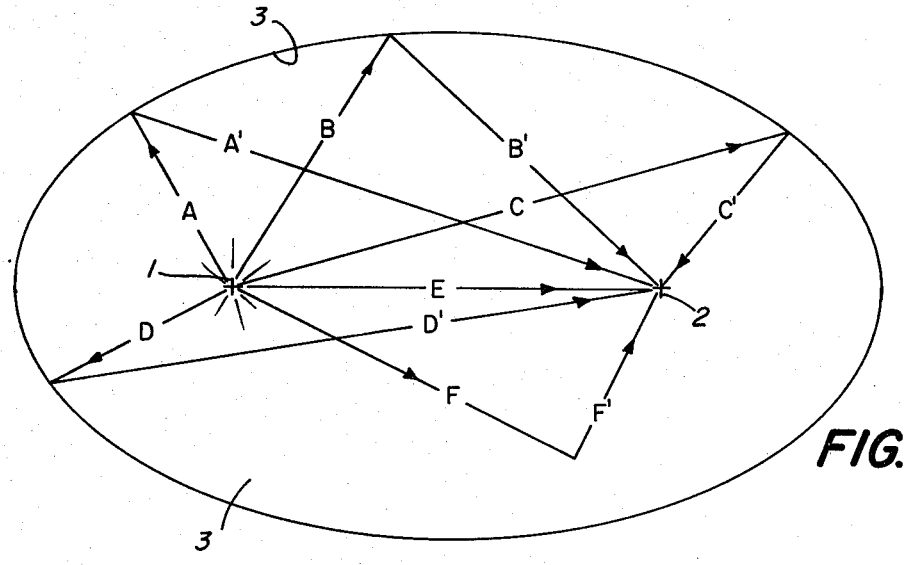
FIG. 1 is a drawing of a longitudinal section through an ellipsoid useful in illustrating the basic operation of the process and apparatus of the invention.

An ellipsoid, that is, a surface all plane sections of which are ellipses or circles, is shown in elliptical cross-section in FIG. 1. As shown, rays A, B, C, D, and E, emanating from focus 1 in various directions lying in the plane of the cross-section, will, after no more than one reflection, be directed to focus 2. Ray E is directed towards focal point 2 and represents the only component of the radiation emitted from focal point 1 which would be transferred to an object located at point 2 absent the reflective interior surface 3 of the ellipsoid. Rays A, B, C, and D comprise emitted components A, B, C, and D, respectively, and reflected components A', B', C', and D' respectively. Ray F illustrates the path of radiation directed inwardly of the plane of FIG. 1. As is characteristic of an ellipsoidal shape, the emitted ray F will impinge upon the surface 3 such that its reflected component F' will be specifically directed to focal point 2.

In an open ended elliptical tunnel, a ray emitted from one focal line having an axial component will nevertheless impinge upon the other focal line unless it exits at the tunnel end prior to reflection or prior to reaching the focal line after reflection. The amount of energy lost through this mechanism will accordingly be reduced as the length of the tunnel is increased. Ellipsoidal shaped end pieces on the tunnel will of course reduce losses of this type. Also, it is possible to position radiant energy recuperators of the type set forth in copending U.S. application Ser. No. 663,370, filed Mar. 3, 1976, now U.S. Pat. No. 4,082,414, to direct radiation back into an open ended tunnel.

Figure 3:
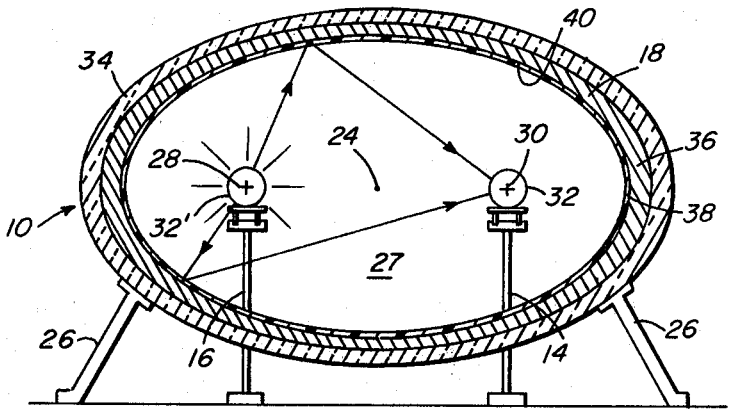
FIG. 3 is a cross section taken along line 3—3 of FIG. 2.
Figure 2:
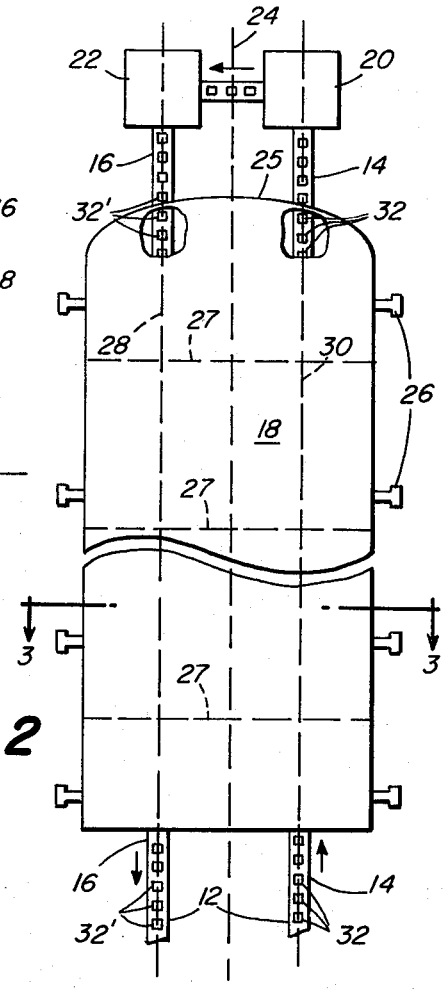
FIG. 2 is a top plan view of apparatus embodying the invention for conserving heat in an assembly line wherein workpieces are heated and thereafter worked and cooled.

Referring to FIGS. 2 and 3, apparatus for conserving heat in a processing line is shown. A conveyor 12 having an incoming portion 14 and an outgoing portion 16 passes through an elongated tunnel 18, a heating station 20, a working station 22, and back through tunnel 18. The tunnel has a longitudinal axis 24 and is mounted on supports 26. Conveyor portions 14 and 16 extend parallel to axis 24 and, as shown in FIG. 3, are located adjacent focal lines 28 and 30 so that workpieces 32, 32' pass therealong. If desired, the tunnel can be fitted with an ellipsoidal shaped end piece 25 and radiative baffles 27. The baffles lie in planes perpendicular to axis 24, are coated on both sides with an infrared reflective material, and divide the tunnel into sections.

As shown in FIG. 3, the interior surface of tunnel 18 comprises a substrate layer 34 which provides structural support for the elliptical chamber, a reflective layer 36 coated onto the support 34, and an infrared-transparent protective layer 38 on the surface of the reflective layer 36. The substrate layer 34 may be made of glass, metal, molded plastic or the like. The radial thickness of reflective layer 36 (greatly exaggerated in the drawing) is preferably between 1 and 20 microns. The reflective layer 36 comprises gold, copper, aluminum, or multiple metallic layered material applied to substrate 34 by vapor deposition, deposition from colloidal suspension, electrodeposition, electroforming, or other means. Relatively oxidation-free materials such as gold and aluminum are preferred. In any case, the reflective layer should have an interior surface 40 of high specular reflectance to the infrared.

Protective layer 38 may comprise polymer films such as those sold under the trademarks PARYLENE and HANDI-WRAP, oxide films of $TiO_2$, $ZrO_2$, MgO, $Al_2O_3$, as well as various proprietary glasses and ceramics. In the case of the metal oxide film, the thickness of the protective coating should not exceed about 1000 Angstroms in order to avoid undesirable interference effects and to attain a high transmission level in the infrared.

The deposition of, for example, $TiO_2$, on, for example, electroformed gold, will provide a highly polished gold reflecting surface which will be nearly impervious to degradation through oxidation because of the resistance of gold to oxidation and because of the protection afforded by the $TiO_2$. An elliptical surface so constructed will also tolerate cleaning and degreasing without scratching or undergoing other forms of reflecting surface degradation, because the $TiO_2$ will serve as a hard overcoat. Finally, provided the $TiO_2$ is smoothly deposited in a suitably thin film, the infrared radiation will be reflected from the specular gold surface essentially without interference.

Examples of other reflective coating-protective coating pairs are as follows.

| Reflective Coating | Protective Coating |
|---|---|
| gold | MgO |
| gold | $Al_2O_3$ |
| gold | $ZrO_2$ |
| aluminum | $ZrO_2$ |
| aluminized Mylar | $ZrO_2$ |
| copper | $ZrO_2$ |
| copper coated Mylar | $ZrO_2$ |
| gold coated Mylar | $ZrO_2$ |

In operation, workpieces or stock 32, substantially at room temperature, are transported by conveyor portion 14 into tunnel 18, and, as illustrated in FIG. 3, moved along focal line 30. Thereafter, the workpieces are heated at heating station 20, transported to working station 22 where, typically, some type of mechanical work is effected, and passed by conveyor portion 16 along focal line 28 of tunnel 18.

Since both the entering and exiting workpiece lines lie along the focal lines of the elliptical cylinder, radiation emanating from the higher temperature stock at focal line 28 will be reflected at the interior surface 40 of the elliptical cylinder and directed specifically to the cooler, incoming stock at the other focal line. The cool incoming stock will act as a heat sink with respect to the warmer outgoing stock which will cool at essentially the same rate as it cools in the open atmosphere. The heat it loses in cooling from the higher temperatures (for example 2000° F.) is almost all lost by radiation, and a large fraction of this radiative heat loss will be transferred to the incoming stock 32.

As an example of the relative heat transfer between high temperature outgoing and low temperature incoming stock, it will be assumed that outgoing stock 32' entering tunnel 18 on conveyor 16 after leaving working station 22 has a temmperature of 2000° F. and stock 32, located on conveyor 14 exiting the tunnel and about to enter heating station 20, has been preheated to 1000° F. Immediately within the tunnel adjacent the stations 20 and 22, the stock at 2000° F. radiate heat at a rate of $62.7\times10^3$ BTU/hr. per square foot of surface, whereas the cooler stock at 1000° F. radiates at a rate of $7.8\times10^3$ BTU/hr. per square foot of surface. Thus, the net radiation transferred from the hot workpieces to the cooler workpieces will be approximately $55.5\times10^3$ BTU/hr. per square foot. This heat flux to the cooler stock will be somewhat decreased by absorption of radiation at the reflective surface, but reflectivity of 0.95–0.97 is routinely attainable employing commercially available coatings on commercially available substrates. Moreover, by flooding the tunnel with filtered air, it will be possible to maintain a high reflectivity over long periods.

The initial heat transfer rate at the end of the tunnel noted above is larger than the heat transfer which will occur further down the tunnel for the following reasons. As the heat flux leaves a high temperature workpiece, the workpiece undergoes a decrease in its surface temperature. Cooling of the entire piece occurs by internal thermal diffusion so that the temperature of the surface of the workpiece, upon which thermal radiation depends, falls even more rapidly than its average temperature. This phenomenon, which limits the effect of the heat transfer from the hot to the cool stock, is controlled by the diameter of the stock, the thermal diffusivity of the stock, and the speed of the conveyor. Thus, within certain limits, the speed of the conveyor can be regulated to enhance heat transfer.

Radiative heat transfer will also occur in the axial directional along the tunnel, and some radiation will be lost through the open ends. As the axial length of tunnel 18 is increased, the fraction of radiation emitted by high temperature pieces 32' which fails to reach cooler incoming pieces 32 will decrease. In any case, if the tunnel ends are fitted with flat reflecting surfaces lying normal to axis 24 or fitted with ellipsoidal shaped pieces having ports of a size sufficient to allow passage of the incoming and outgoing workpieces on the line, there losses can be kept to a minimum. In certain applications it may also be useful to place planar reflective surfaces 27 at various points along the length of the tunnel to divide the tunnel into sections and to deflect rays having an axial component to focal line 30.

Calculations indicate that in a process line as set forth above, where the stock of workpieces consist of light parts which leave the forming station at 2000° F., it should be possible to preheat the stock to a temperature of about 1000° F.

Figure 4:
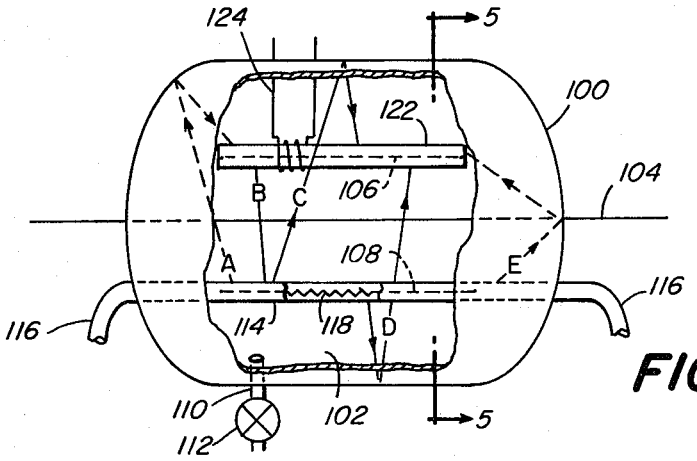
FIG. 4 is a schematic, partially cut-away view of apparatus embodying the invention designed to subject a workpiece of metal or the like to a controlled thermal cycle.
Figure 5:
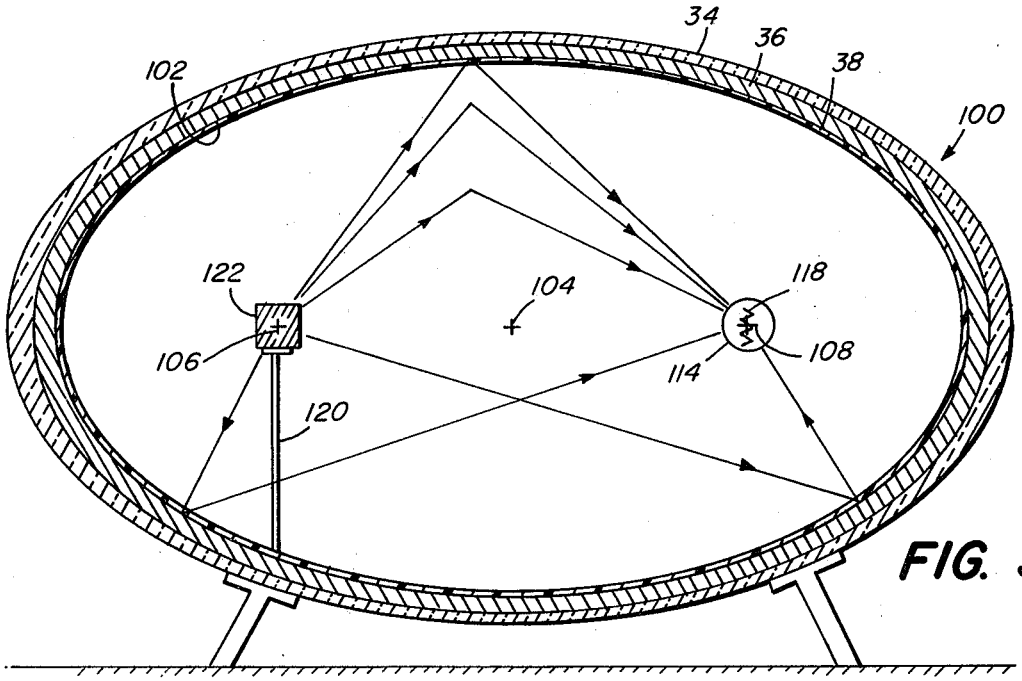
FIG. 5 is a cross-sectional view of the apparatus of FIG. 4 taken along line 5—5.

FIGS. 4 and 5 illustrate apparatus embodying the invention which may be used to subject a workpiece to a given thermal cycle such as is required with certain steels and in some specialized glass making procedures. The apparatus comprises an enclosed chamber 100, which as shown in FIG. 5, has an interior infrared reflective surface 102 and a construction similar to that of the elliptical tunnel of FIG. 3. As shown in FIG. 4, the chamber can take the form of a cylinder having an elliptical cross-sectional shape in planes taken perpendicular to its longitudinal axis 104. The ends of the cylinder have an ellipsoidal shape, resulting in a structure having a pair of focal lines 106 and 108 running parallel to longitudinal axis 104. Alternatively, the chamber can take the form of a true ellipsoid (not shown). Chamber 100 is preferably constructed similar to the apparatus described above and shown in FIG. 3. However, substrate 34 should be made of material strong enough to withstand external pressure resulting on evacuation of the interior of the chamber and internal pressure resulting from operation of the apparatus under a high-pressure enclosed temperature. For providing such atmospheres, or for providing atmospheres of ambient pressure inert gas, the apparatus features pipe 110 which communicates with the interior of chamber 100 and is fitted with a pump 112.

An elongated infrared radiation emitter/absorber 114 is located along focal line 108. As shown, the emitter/absorber comprises a hollow, thin, light-weight tube which is sealed to the interior of chamber 100 but accessible from the exterior via pipes 116. The surface of the tube exposed to the interior of the cavity, at least along the length of the focal line 108, is coated with a high emissivity material such as a metal oxide. A heating element 118 is disposed within the tube. A workpiece support 120, disposed adjacent focal line 106 as shown in FIG. 5, is preferably a light-weight, small cross-section material having a highly reflective coating. The support could also comprise a suspended fine wire structure (not shown). Support 120 is located such that a workpiece, illustrated as an elongated bar 122, lies more or less coincident with focal line 106. The apparatus may also include an induction heating oil, illustrated schematically at 124, for rapid heating of workpiece 122.

In operation, the material to be processed is placed at the focal line 106, and if susceptible to induction heating, is heated by the induction coil 124. Alternatively, the high temperature heat source 118 may be activated, thereby causing emitter 114 to emit omnidirectional infrared, and possibly visible, radiation which, as shown schematically by rays A, B, C, D, and E (FIG. 4) are reflected at the interior reflective surface in a manner described with reference to FIG. 1, directed to workpiece 122, and absorbed. Any conventional viewing or temperature measuring system can be provided so that the surface temperature of the workpiece being processed can be monitored continuously. Also, an appropriate conventional feedback control can be employed continuously to adjust the power flux into the heater to yield the rate of heating desired or to maintain a given temperature.

When the desired temperature has been attained in the material being processed, the power in the induction coil 124 or heating coil 118 is shut down, and the emitter/absorber 114 is allowed to cool. Left alone, it will come to thermal equilibrium with the material being processed by an exchange of infrared radiation absorbed and emitted between the focal lines. From this time on, as the surface of the chamber and the workpiece or emitter/absorber exchange heat by reflection in the elliptical cavity, there will be a certain amount of absorption of radiation at the reflective surface since reflectance can never be 100%. Losses of heat through the structure of the chamber will accordingly be encountered. However, through proper choice of reflective materials for the interior surface, it is possible to limit this loss to a few percent (2–3%) of the reflected radiant heat flux. By suitable adjustment of the power to the electrical heater in the emitter/absorber, it is possible to compensate for this loss and to maintain a selected workpiece temperature indefinitely.

If it is now necessary to decrease the temperature of workpiece 122, after, for example, it has been held at a fixed temperature for a selected period of time, a cooling fluid may be pumped through pipes 114 in order to place the emitter/absorber into the infrared absorption mode. Thus, pipe 114 will act as a heat sink which absorbs infrared radiation emitted by the now higher temperature workpiece 122 (See FIG. 5). By controlling the flow of the fluid stream passing through emitter-absorber 114, it is possible to control the heat transfer rate from the workpiece sufficiently well to produce a selected cooling cycle.

Figure 6:
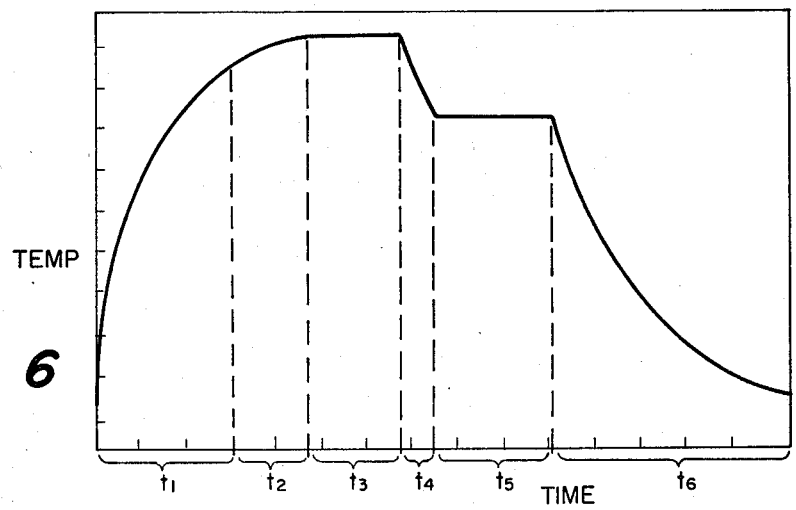
FIG. 6 is a graph of temperature vs. time illustrating an exemplary thermal cycle to which a given material may be subjected in accordance with the process and apparatus of the invention.

FIG. 6 illustrates one exemplary thermal cycle that may be conducted using the apparatus of FIGS. 4 and 5. During time $t_1$, the workpiece is rapidly heated by absorption of reflected infrared radiation emitted from emitter/absorber 114 acting in the emitting mode or by an induction coil. As the temperature of the workpiece approaches that of the emitter, its rate of temperature rise decreases ($t_2$). When the desired temperature is reached, it can be maintained ($t_3$) by adjusting the output of the emitter to match the losses of energy due to absorption by the reflective surface 102. Rapid cooling of the workpiece is thereafter effected ($t_4$) by passing a cooling fluid through emitter/absorber 114 so that it functions in the absorption mode, absorbing infrared radiation emitted by the now hotter workpiece 122. When a selected lower workpiece temperature is reached, it may be maintained for any given period of time ($t_5$). Lastly, when it is desired to bring the workpiece back to room temperature, this step may be accomplished at a controlled rate ($t_6$) simply by controlling the temperature and thus the rate of absorption of tube 114.

The limit of the heat flux which may be extracted from the workpiece via the technique described above depends solely on the temperature of the workpiece. In the ranges of temperatures of interest here (1000°–3000° F.), the emissivities of most materials of interest (steels, stainless steels, other metals, certain ceramics and glasses) will be about 0.85 or more. In general, as the temperature increases, the emissivity of materials tends to increase asymtotically toward unity. For a steel part raised to, for example, 1700° F., the radiant heat flux that could be removed from the part by cooling the tube to, for example, 0° F., would be approximately $31.6\times10^3$ BTU/hr·ft$^2$. The specific heat of steel is approximately 0.1 BTU/lb·°F. A cube with a surface area of 1.0 ft.$^2$ weighs 32.9 pounds. If the cube were cooled under the conditions given above, the average cooling rate would be approximately 2.66 °F./sec. Cooling from higher temperatures, or from less massive parts, would of course take place at greater rates.

The apparatus described above can also be used to carry out certain metal treating processes which require atmospheres of a controlled composition and/or pressure. For example, the rate of reaction in carbonitriding of steels can be significantly accelerated by conducting the reaction in a high pressure nitrogen atmosphere. While it is awkward to build and use furnaces which must run both at high temperature and high pressure, the elliptical cavities described herein can be used to transfer heat by thermal radiation to a workpiece which is to be reacted with carbon and nitrogen under high pressure or, in fact, under almost any atmosphere desired. Furthermore, the apparatus of the invention can effect such reactions without heating up the cavity walls, thus greatly simplifying furnace construction. Heat will diffuse from the workpiece into the surrounding gas as the reaction proceeds but such convection is relatively slow. Thus, it should be possible to design a furnace so that the diffusion of heat has a negligible effect during the time of reaction. For example, the elliptical envelope could be contained in a separate surrounding pressure vessel thermally isolated from the heating chamber.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for conserving heat in a system wherein a plurality of workpieces are sequentially transported by a conveyor means through a heating station and a working station and are subsequently cooled, said apparatus comprising:

a tunnel having a longitudinal axis parallel to which workpieces are transported by portions of said conveyor means prior to entering the heating station and after exiting the working station in a heated condition, said tunnel having an interior infrared radiation reflective surface which, in planes perpendicular to the axis, describes an ellipse having a pair of separated foci, the portions of said conveyor means passing through said tunnel being located adjacent said foci so that workpieces on the conveyor means prior to entering the heating station and after exiting the working station pass along respective focal lines in said tunnel, said apparatus being operable to transfer heat from workpieces exiting from the working station to workpieces entering the heating station by reflecting infrared radiation emitted by exiting workpieces at the interior surface and directing said radiation at the focal line along which entering workpieces pass.

2. The apparatus of claim 1 wherein the minor semi axis of said elliptical cross-section is about ten times as great as the workpiece dimension in directions perpendicular to said axis.

3. The apparatus of claim 1 further comprising at least two baffles having infrared reflective coatings and being arranged to intercept and reflect infrared radiation generated in said tunnel and having an axial directional component.

4. The apparatus of claim 1 wherein said reflective surface reflects specularly at least in the infrared.

5. Apparatus for heat treating a workpiece such as by heating, cooling, or maintaining a given temperature of the workpiece so that it can be subjected to a controlled thermal cycle, said apparatus comprising:

an enclosed chamber having an interior, infrared radiation reflective surface which, in at least one cross-section, describes an ellipse having a pair of separated foci;

a workpiece support located adjacent one focus for positioning a workpiece at said focus;

means for heating a workpiece located on said support, and;

a temperature controllable infrared radiation absorber located at the other focus;

said apparatus being operable to heat a workpiece and to control the temperature of said workpiece in response to control of the temperature of said absorber.

6. The apparatus of claim 5 wherein the chamber describes a tube having a longitudinal axis, said tube being sealed at both ends and having an elliptical cross-section perpendicular to said axis, said absorber comprising an elongate structure spaced along a focal line.

7. The apparatus of claim 5 wherein said heating means comprises an induction coil heater mounted adjacent said support.

8. The apparatus of claim 5 wherein said controllable absorber comprises a hollow object having a high emissivity surface exposed to the interior of the chamber and a port communicating with the exterior of the chamber for passing cooling fluids through said hollow object.

9. The apparatus of claim 8 wherein said absorber further includes infrared radiation emitting means, said apparatus being operable to maintain a workpiece at a selected temperature by providing heat to the workpiece at a rate equal to the rate of heat loss from the apparatus.

10. The apparatus of claim 5 wherein said reflective surface reflects specularly at least in the infrared.

11. The apparatus of claim 5 further comprising means for providing atmospheres of a controlled pressure within said enclosed chamber.

12. Apparatus according to claim 5, in which the radiation absorber has a surface of high emissivity.

13. Apparatus according to claim 12, including cooling means in heat conductive communication with said infrared radiation absorber for variably removing heat therefrom to the exterior of said enclosure.

14. Apparatus according to claim 13, including temperature sensing means responsive to the temperature of the workpiece, the cooling means being responsive to the temperature sensing means.

15. Apparatus according to claim 12, in which the means for heating the workpiece comprise infrared heating means located substantially at said other focus.

16. A process for cooling a workpiece of the type capable of losing heat and decreasing in temperature by the emission of infrared radiation, said process comprising the steps of:

A. providing an enclosure having:

an interior cross section which, in at least one plane, substantially conforms to an ellipse having a pair of separated foci, and an interior infrared reflective surface;

B. placing an object capable of absorbing infrared radiation at one of said foci;

C. placing said workpiece at the other of said foci; and

D. allowing said workpiece to transfer heat to said object by emitting omnidirectional infrared radiation which is reflected at said interior surface, directed to said object, and absorbed thereby.

17. The process of claim 16 wherein said enclosure is a tunnel having a longitudinal axis and an elliptical cross section perpendicular to said axis, said object is a workpiece at a first temperature, and the workpiece at said other focus is at a temperature higher than said first temperature.

18. The process of claim 17 comprising the further step of transporting workpieces along the focal lines of said tunnel.

19. The process of claim 16 wherein said enclosure is sealed and said object comprises a temperature controlled body having a high emissivity surface, said process comprising the further step of controlling the cooling rate of the workpiece by regulating the temperature of the temperature controlled body.

20. The process of claim 19 comprising the further steps of:

providing an induction heating coil adjacent the workpiece;

heating the workpiece with said induction coil; and passing the workpiece through a controlled cooling cycle by regulating the temperature of said temperature controlled body to control the rate of or arrest cooling of said workpiece.

21. The process of claim 19 wherein the workpiece comprises a material selected from the group consisting of glasses, ceramics, and metals.

22. Apparatus for controllably cooling a workpiece comprising:

an enclosure having an interior cross-section which, in at least one plane, substantially conforms to an ellipse having a pair of separated foci and an interior infrared reflective surface;

an infrared radiation absorber positionable at one of said foci, a workpiece support located at the other of said foci; and means for controlling absorption of infrared radiation by said infrared radiation absorber.

23. The apparatus of claim 22 wherein said enclosure is sealed and said absorber comprises a temperature controlled body having a high emissivity surface mounted at said one of said foci.

* * * * *